US011132979B2

(12) United States Patent
Lee et al.

(10) Patent No.: US 11,132,979 B2
(45) Date of Patent: Sep. 28, 2021

(54) DEVICE FOR CORRECTING IMAGE OF TRANSPARENT DISPLAY DEVICE, TRANSPARENT DISPLAY DEVICE USING THE SAME, AND METHOD FOR DRIVING THE DISPLAY DEVICE

(71) Applicant: LG DISPLAY CO., LTD., Seoul (KR)

(72) Inventors: Heeeun Lee, Seoul (KR); Jaehong Kim, Paju-si (KR); Mincheol Kim, Gunpo-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/895,663

(22) Filed: Jun. 8, 2020

(65) Prior Publication Data

US 2021/0005160 A1 Jan. 7, 2021

(30) Foreign Application Priority Data

Jul. 4, 2019 (KR) ..... 10-2019-0080945

(51) Int. Cl.
*G09G 5/10* (2006.01)
*G09G 3/3225* (2016.01)

(52) U.S. Cl.
CPC ..... *G09G 5/10* (2013.01); *G09G 3/3225* (2013.01); *G09G 2310/027* (2013.01); *G09G 2320/0646* (2013.01); *G09G 2360/144* (2013.01)

(58) Field of Classification Search
CPC ..... G09G 2310/027; G09G 2320/0646; G09G 2360/144; G09G 3/3225; G09G 5/10; G09G 3/3208; G09G 3/20; G09G 3/3607; G09G 3/3233; G09G 5/30; H01L 51/5234; H01L 27/3232; G02F 1/1343; G02B 26/005
See application file for complete search history.

(56) References Cited

U.S. PATENT DOCUMENTS

2013/0314453 A1* 11/2013 Ko ..... G09G 5/10 345/690
2014/0176625 A1* 6/2014 Yoon ..... G09G 3/3233 345/691
2014/0184577 A1* 7/2014 Kim ..... G02B 26/005 345/207
2016/0027388 A1* 1/2016 Seo ..... G09G 3/20 345/690

(Continued)

FOREIGN PATENT DOCUMENTS

KR 10-2015-0136052 A 12/2015

*Primary Examiner* — Richard J Hong
(74) *Attorney, Agent, or Firm* — Birch, Stewart, Kolasch & Birch, LLP

(57) ABSTRACT

A correction device for correcting luminance of a display image based on background illuminance and transmittance of a transparent display panel, a transparent display device using the same, and a method for driving the display device are discussed. The correction device can correct luminance of a display image in real time based on a background-affected illuminance of a transparent display panel. Further, an optimal peak luminance of the display image is adjusted based on the background-affected illuminance of the transparent display panel, while adding a weight to a dark environment such that the peak luminance is further lowered, thereby reducing an amount of power consumption while maintaining display quality of the transparent display image.

18 Claims, 7 Drawing Sheets

(56) References Cited

U.S. PATENT DOCUMENTS

| | | | | |
|---|---|---|---|---|
| 2017/0069277 | A1* | 3/2017 | Hsieh | G09G 3/3607 |
| 2017/0177150 | A1* | 6/2017 | Chang | G09G 5/30 |
| 2018/0267313 | A1* | 9/2018 | Kim | G09G 3/20 |
| 2019/0035357 | A1* | 1/2019 | Lim | G09G 3/3208 |
| 2019/0198596 | A1* | 6/2019 | Lee | H01L 27/3232 |
| 2019/0349550 | A1* | 11/2019 | Bang | G02F 1/1343 |
| 2020/0212363 | A1* | 7/2020 | Park | H01L 51/5234 |

* cited by examiner

【FIG. 1】
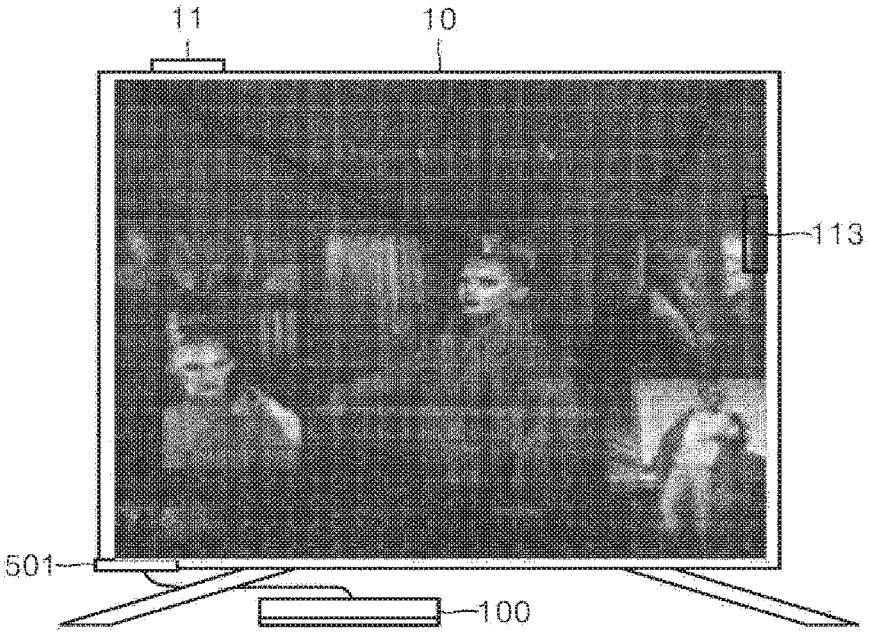

【FIG. 2】
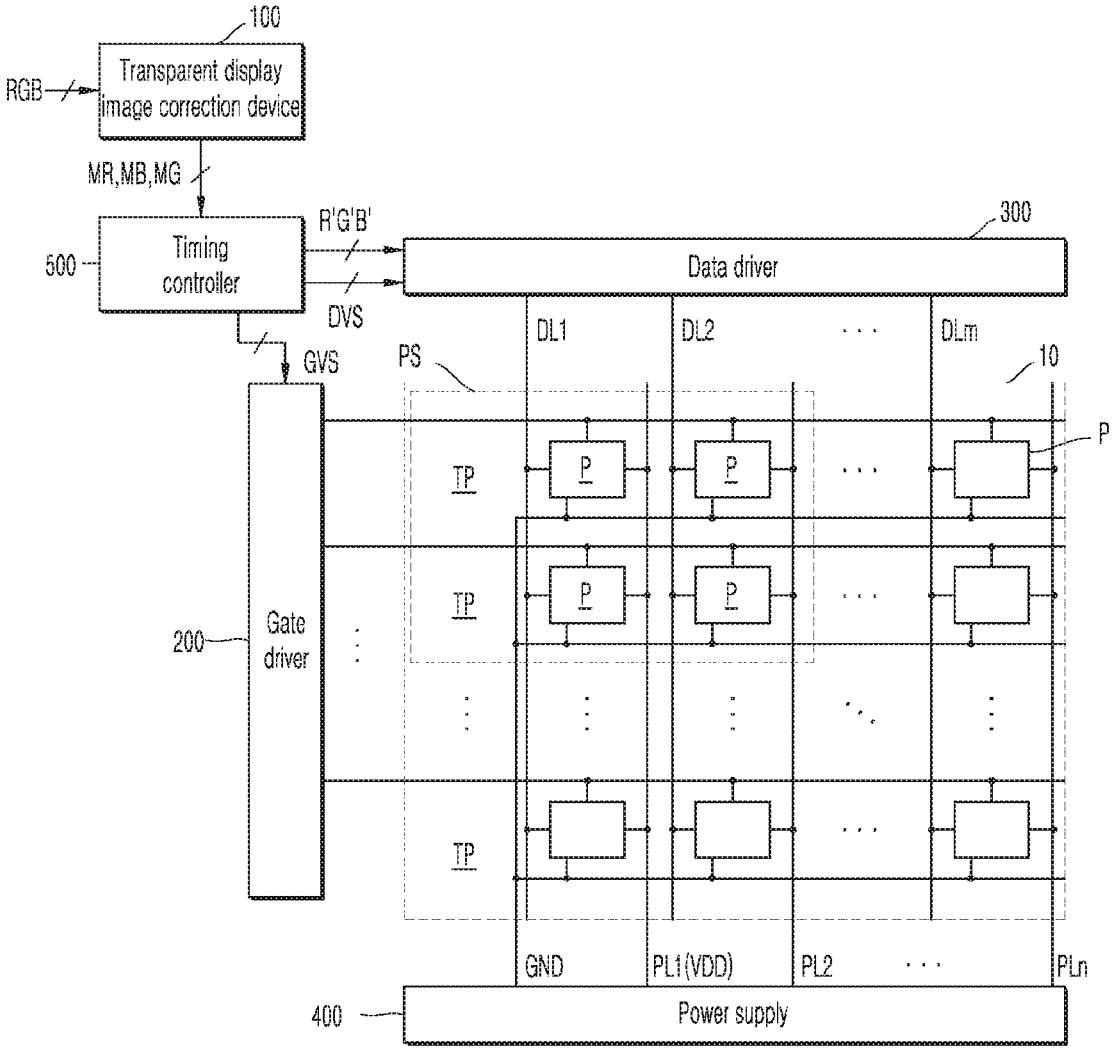

【FIG. 3】
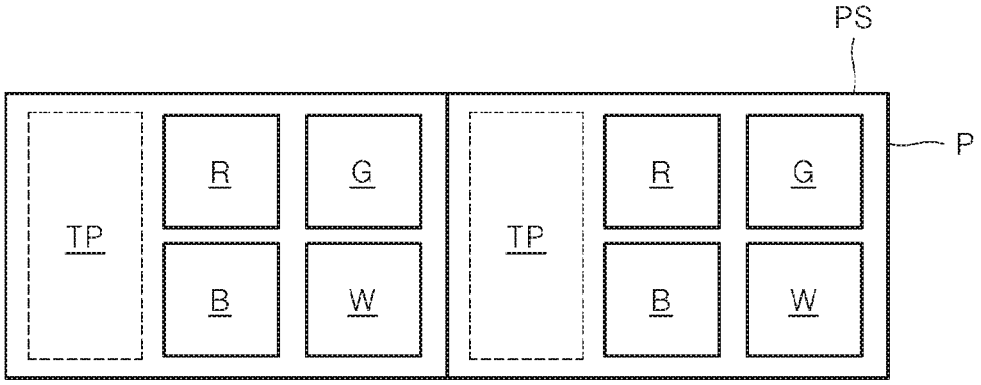
(a)
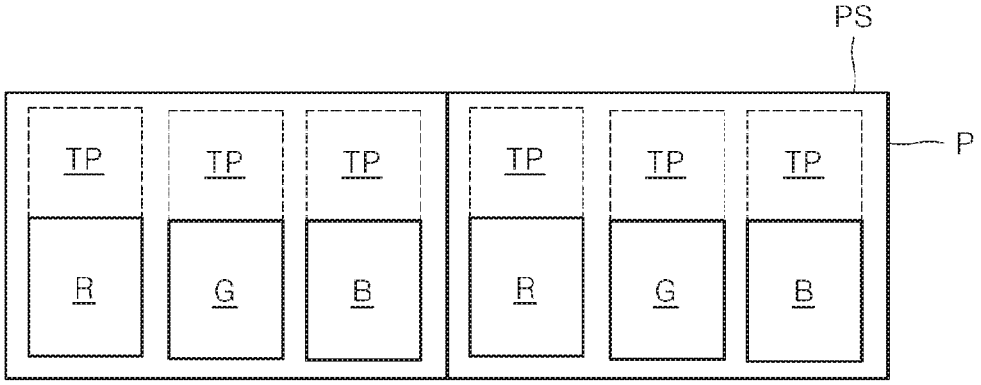
(b)

【FIG. 4】
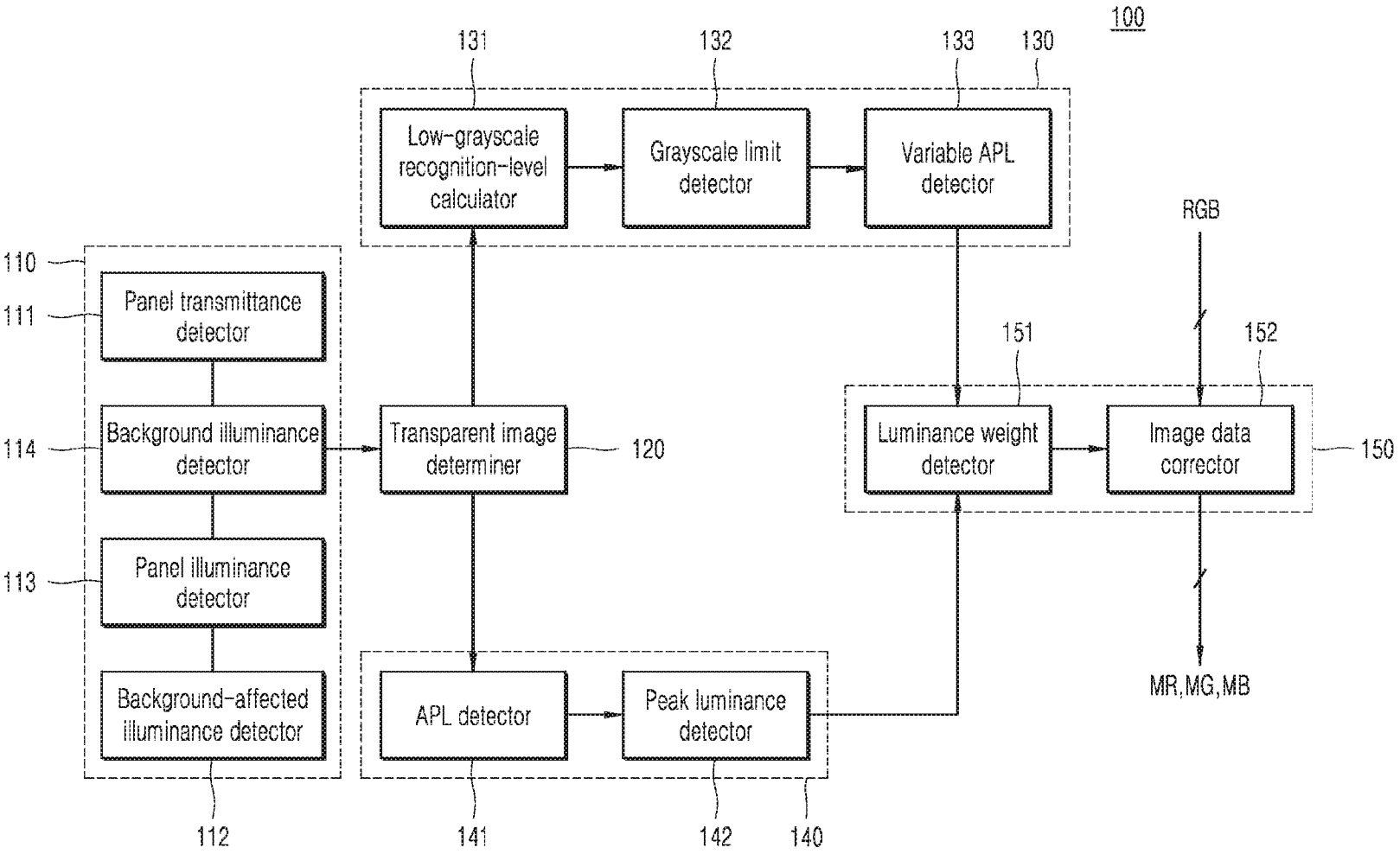

【FIG. 5】
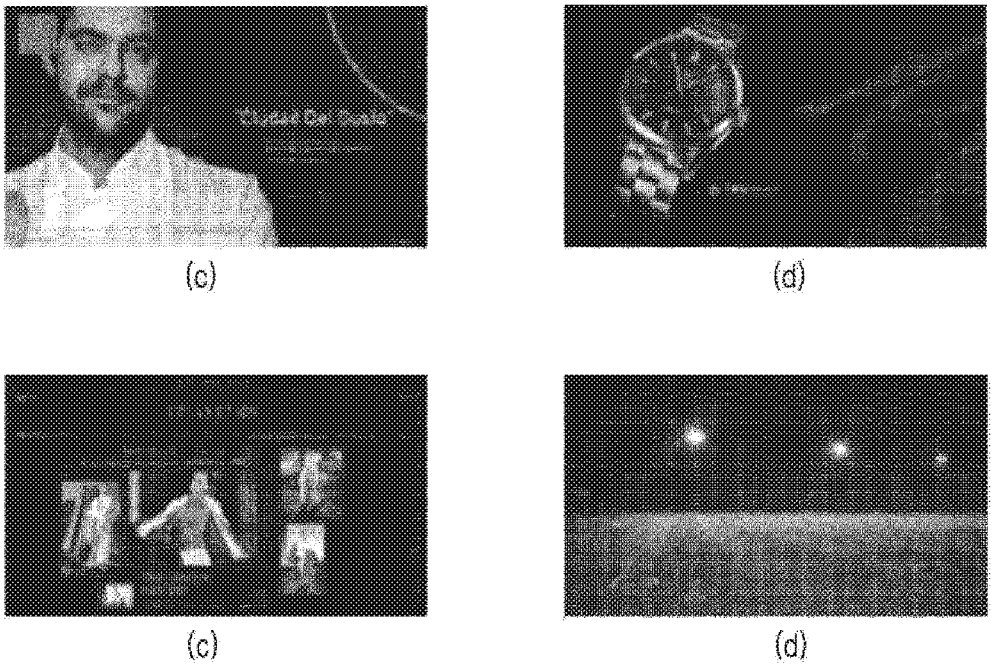
Number of low-grayscale pixels (or Black Pixel number) / Total number of pixels corresponding to frame (%) > Reference percentage(65%)

【FIG. 6】
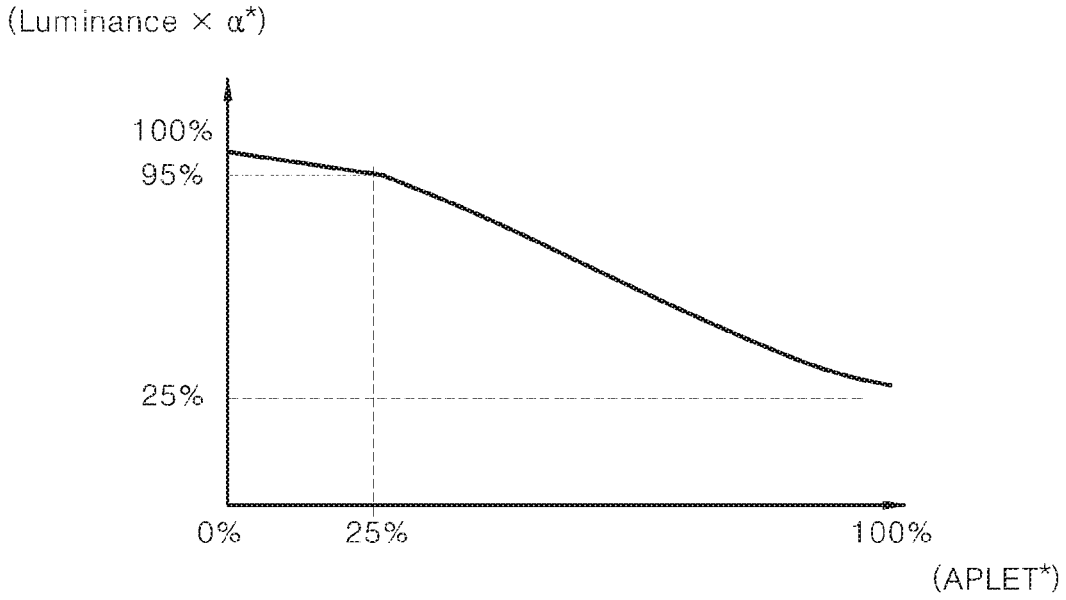
【FIG. 7】
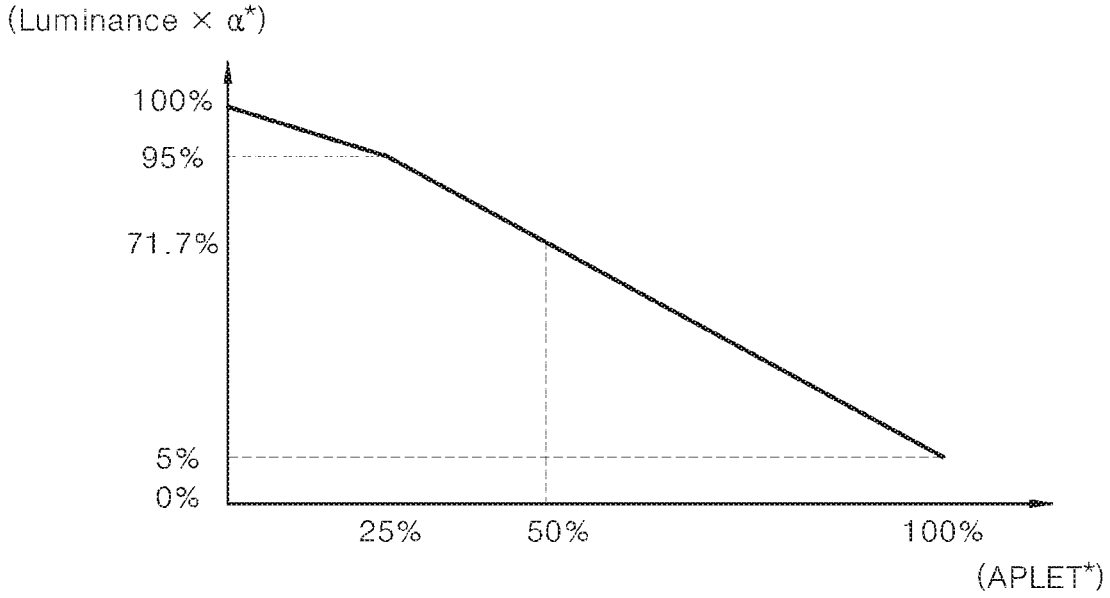

【FIG. 8】
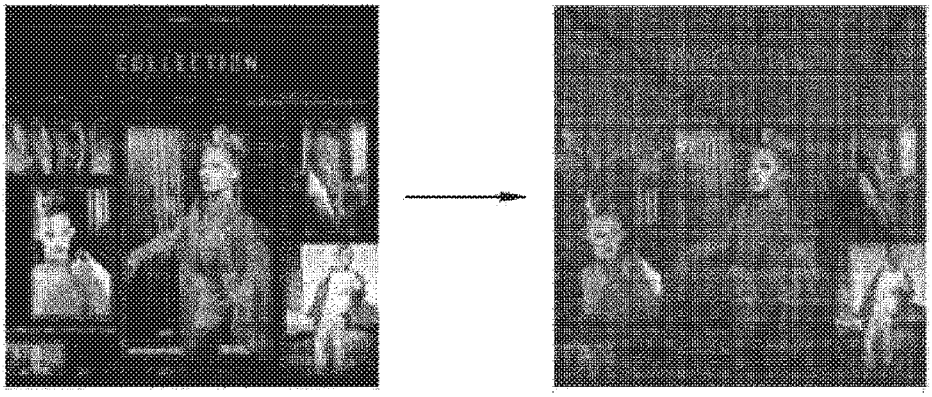
(a) (b)

DEVICE FOR CORRECTING IMAGE OF TRANSPARENT DISPLAY DEVICE, TRANSPARENT DISPLAY DEVICE USING THE SAME, AND METHOD FOR DRIVING THE DISPLAY DEVICE

CROSS-REFERENCE TO RELATED APPLICATIONS

This application claims priority to Korean Patent Application No. 10-2019-0080945 filed on Jul. 4, 2019, in the Korean Intellectual Property Office, the entire contents of which are hereby expressly incorporated by reference in its entirety into the present application.

BACKGROUND

1. Technical Field

The present disclosure relates to a transparent display device. More specifically, the present disclosure relates to a device (hereinafter also referred to as a transparent display image correction device) for correcting luminance of a display image based on background illuminance and transmittance of a transparent display panel, a transparent display device using the same, and a method for driving the display device.

2. Description of the Related Art

A flat display panel can be enlarged or miniaturized, and can be applied to various fields and can be used to manufacture various types of display panels.

Generally, the flat display panel are implemented as a plasma display panel (PDP), a liquid crystal display panel (LCD), an organic light-emitting diode display (OLED) panel, and the like.

In recent years, application of the flat display panel has been further expanded. In one example, the flat display panel can be applied to a transparent display panel. The transparent display panel can be implemented as an OLED panel that does not require a backlight unit.

A transparent display device having the transparent OLED panel can display various images using the display panel having a predetermined transmittance. The transparent display device can be used in various fields such as show windows, billboards, home appliance doors, and public displays.

SUMMARY

A conventional transparent display device does not consider transmittance and background illuminance of a transparent display panel. Rather, the conventional transparent display device simply considers brightness information of an image, such that only a previously produced image is displayed thereon. Specifically, the higher the background illuminance and the brighter an environment, the lower a recognition-level of a dark low-grayscale image. Accordingly, conventionally, in order to display an image not only in a dark environment but also in a bright environment, the display device selectively displays only an image containing high-grayscale data with high luminance at a reference amount.

Thus, when the background illuminance is not considered but only the high luminance image is displayed, power consumption can be inevitably increased due to the increase in a peak luminance for each frame. Further, a selection range and thus an application range of the transparent display image can be narrowed, which can limit an application range of the transparent display device.

A purpose of the present disclosure is to provide an improved correction device for correcting an image on a transparent display device to increase utilization efficiency of the transparent display device and widen an application range thereof, to provide the transparent display device using the correction device, and to provide a method for driving the display device.

Specifically, a purpose of the present disclosure is to provide an improved correction device for correcting an image on a transparent display device in which a background-affected illuminance is calculated based on a transmittance and a background illuminance of a transparent display panel, and then a luminance of a display image is controlled based on the calculated background-affected illuminance, to provide the transparent display device using the correction device, and to provide a method for driving the display device.

Further, a purpose of the present disclosure is to provide an improved correction device for correcting an image on a transparent display device in which an optimal peak luminance of a display image is adjusted based on a background-affected illuminance of a transparent display panel, while a weight is added to a dark environment to further lower a peak luminance, to provide the transparent display device using the correction device, and to provide a method for driving the display device.

The purposes of the present disclosure are not limited to the above-mentioned purposes. Other purposes and advantages of the present disclosure, as not mentioned above, can be understood from the following descriptions and more clearly understood from the embodiments of the present disclosure. Further, it will be readily appreciated that the objects and advantages of the present disclosure can be realized by features and combinations thereof as disclosed in the claims.

An embodiment according to the present disclosure provides a transparent display image correction device that can change a luminance of a display image based on a transmittance and a background illuminance of a transparent display panel. The transparent display image correction device detects a background-affected illuminance of the transparent display panel using an illuminance detector, and analyzes a grayscale of an image data input externally using a transparent image determiner to determine whether the image data is suitable for transparent display (hereinafter also referred to herein as transparent display-applicable image data). A transparent optimal image analyzer extracts an average grayscale value variable based on a grayscale value corresponding to a low-grayscale recognition-level limit from the determined transparent display-applicable image data. Then, a data corrector adjusts a peak luminance of the image data based on the background-affected illuminance and the average grayscale value, thereby to create corrected image data.

Further, an embodiment according to the present disclosure provides a transparent display device capable of varying an optimal peak luminance of a display image based on a background-affected illuminance of a transparent display panel. The transparent display device include a transparent display image correction device to calculate the background-affected illuminance in real time based on a transmittance and a background illuminance of the transparent display panel, and an illuminance of a display image, and to vary an image data so that a peak luminance of the display image changes in real time based on the calculated background-affected illuminance, thereby to create corrected image data.

Further, an embodiment according to the present disclosure provides a method for driving a transparent display device so as to vary an optimal peak luminance of a display image based on a background-affected illuminance of a transparent display panel. The method includes calculating the background-affected illuminance in real time based on a transmittance and a background illuminance of the transparent display panel, and an illuminance of a display image, and varying an image data so that a peak luminance of the display image changes in real time based on the calculated background-affected illuminance, thereby to create corrected image data. Further, the method further includes aligning the corrected image data based on driving characteristics of the transparent display panel and displaying the aligned data on the transparent display panel.

The transparent display image correction device, the transparent display device using the same and the method for driving the display device according to an embodiment of the present disclosure can correct the luminance of the display image in real time based on the background-affected illuminance of the transparent display panel and then display the corrected image data. In this way, the luminance of an input image can be adjusted in real time and then the corrected image data can be display, without separately producing or distinguishing a transparent display image. Thus, an application range of the transparent display device can be further expanded.

Further, the optimal peak luminance of the display image is adjusted based on the background-affected illuminance of the transparent display panel, while adding the weight to a dark environment such that the peak luminance can be further lowered. In this way, the peak luminance can be lowered in the dark environment, thereby reducing an amount of power consumption while maintaining display quality of the transparent display image.

Further, specific effects of the present disclosure as well as the effects as described above will be described in conduction with illustrations of specific details for carrying out the present disclosure.

BRIEF DESCRIPTION OF DRAWINGS

The present disclosure will become more fully understood from the detailed description given hereinbelow and the accompanying drawings which are given by way of illustration only, and thus are not limitative of the present disclosure and wherein:

FIG. 1 is a plan view showing a transparent display image correction device and a transparent display device using the same according to an embodiment of the present disclosure.

FIG. 2 is a block diagram showing an example of the transparent display image correction device and the transparent display device shown in FIG. 1.

FIG. 3 is a block diagram to illustrate an example of a unit pixel structure of a transparent display panel in FIG. 1.

FIG. 4 is a block diagram specifically showing an example of the transparent display image correction device shown in FIG. 1 and FIG. 2.

FIG. 5 is a diagram for illustrating a transparent image determination method by a transparent image determiner shown in FIG. 4.

FIG. 6 is a graph to illustrate a method for setting a luminance weight by a luminance weight detector shown in FIG. 4.

FIG. 7 is a graph to illustrate a peak luminance detection method and a peak luminance correction method by a non-transparent image analyzer shown in FIG. 4.

FIG. 8 is a view showing an example of image data input to the transparent display image correction device in FIG. 4 and a transparent display image corresponding to the image data whose luminance is corrected.

DETAILED DESCRIPTION OF THE EMBODIMENTS

For simplicity and clarity of illustration, elements in the figures are not necessarily drawn to scale. The same reference numbers in different figures represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure can be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as can be included within the spirit and scope of the present disclosure as defined by the appended claims.

The terminology used herein is for the purpose of describing particular embodiments only and is not intended to limit the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements can modify the entire list of elements and may not modify the individual elements of the list.

It will be understood that, although the terms "first", "second", "third", and so on can be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element can be disposed directly on or beneath the second element or can be disposed indirectly on or beneath the second element with a third element or layer being disposed between the first and second elements or layers.

It will be understood that when an element or layer is referred to as being "connected to", or "coupled to" another element or layer, it can be directly on, connected to, or coupled to the other element or layer, or one or more intervening elements or layers can be present. In addition, it will also be understood that when an element or layer is referred to as being "between" two elements or layers, it can be the only element or layer between the two elements or layers, or one or more intervening elements or layers can also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a transparent display image correction device according to an embodiment of the present disclosure, a transparent display device using the same, and a method for driving the display device will be described. All the components of the transparent display image correcting device and the transparent display device are operatively coupled and configured.

FIG. 1 is a plan view showing a transparent display image correction device and a transparent display device using the same according to an embodiment of the present disclosure. FIG. 2 is a block diagram showing the transparent display image correction device and the transparent display device shown in FIG. 1.

Referring to FIG. 1, a transparent display image correction device 100 can be configured to be received in a set-top box or a separate casing, which can be separate from a transparent display panel 10 for displaying an image or a transparent display device including the transparent display panel 10. Alternatively, as shown in FIG. 2, the transparent display image correction device 100 can be integral with the transparent display panel 10 or the transparent display device that displays an image.

The transparent display image correction device 100 calculates a background-affected illuminance of the transparent display panel 10 in real time, and correct image data RGB so that a peak luminance of a display image is adjusted based on the calculated background-affected illuminance, thereby to create corrected image data MR, MG, and MB. The generated corrected image data MR, MG, and MB is supplied to a timing controller 500 of the transparent display device via an input module 501 of the transparent display device.

Detailed components and arrangement thereof of the transparent display image correction device 100 shown in FIG. 1 and FIG. 2 will be described in more detail with reference to FIG. 4.

First, referring to FIG. 2, the transparent display device includes the transparent display panel 10, a gate driver 200, a data driver 300, a power supply 400, and a timing controller 500.

The transparent display panel 10, shown in FIG. 2, can be embodied as a display panel that does not require a backlight unit other than an organic light-emitting diode display panel. However, Hereinafter, for convenience of illustration, an example in which the transparent display panel 10 is embodied as the organic light-emitting diode display panel will be set forth.

FIG. 3 is a configuration diagram to illustrate a unit pixel structure of the transparent display panel in FIG. 2.

Referring to FIG. 3, the transparent display panel 10 is composed of unit pixels PS arranged in a matrix form. Each unit pixel PS includes a transmissive portion TP and a plurality of sub-pixels P.

As shown in (a) in FIG. 3, the transmissive portion TP of each unit pixel PS can extend in a vertical stripe. Each of the sub-pixels P included in each unit pixel PS is configured to include an organic light-emitting diode and a diode driving circuit that independently drives a corresponding light-emitting diode unlike the transmissive portion TP. The diode driving circuits supply analog image signals from data lines DL1 to DLm (where m is a positive number) connected thereto respectively to the light-emitting diodes while allowing the analog image signals to be charged, thereby to maintain a light-emitting state thereof. The sub-pixels P configured as described above can be arranged to emit red, green, blue, and white light beams respectively, or to emit red, green, and blue light beams respectively.

As shown in (b) in FIG. 3, each of the transmissive portions TP of each unit pixel PS can extend in a horizontal stripe. In this case, each transmissive portion TP can be adjacent to each sub-pixel P. The sub-pixels P can be arranged to emit red, green, and blue light beams respectively.

The transparent display panel 10 has different transmission characteristics based on an area and a transmittance of the transmissive portion TPs extending in various forms such as the vertical and horizontal stripes. The transparent display panel 10 displays images having characteristics that change in real time due to the transmission characteristic of the panel 10 and various surrounding environment variations such as illuminance variation of a use environment (background).

Accordingly, the transparent display image correction device 100 according to the present disclosure calculates in real time the illuminance of the use environment, for example, a background-affected illuminance, which varies in real time due to surrounding brightness variation in addition to the transmission characteristic of the transparent display panel 10 itself. Further, the transparent display image correction device 100 according to the present disclosure adjusts an optimal peak luminance of a display image in real time, based on the calculated background-affected illuminance, while lowering a peak luminance in a dark environment. Thus, the image data RGB is corrected.

To display an image corresponding to the corrected image data MR, MG, and MB from the transparent display image correction device 100 on the transparent display panel 10, the gate driver 200 sequentially generates a gate on signal in response to reception of a gate control signal GVS from the timing controller 500, for example, to reception of a gate start pulse GSP and a gate shift clock GSC. The gate driver 200 controls a pulse width of the gate on signal in response to reception of a gate output enable GOE. The gate driver 200 sequentially supplies the gate on signal to gate lines GL1 to GLn where n is a positive number.

The data driver 300 converts the aligned corrected image data R'G'B' (e.g., corrected red, green blue image date) from the timing controller 500 into an analog voltage, that is, an analog image signal, based on a source start pulse SSP and a source shift clock SSC among data control signals DVS from the timing controller 500. The data driver 300 supplies the image signal to each of data lines DL1 to DLm in response to reception of a source output enable SOE. Specifically, the data driver 300 latches the input image data based on the SSC, and then, in response to reception of the SOE, supplies the image signal corresponding to one horizontal line to each of the data lines DL1 to DLm for each horizontal period for which a scan pulse is supplied to each of the gate lines GL1 to GLn.

The timing controller 500 aligns the corrected image data MR, MG, and MB from the transparent display image correction device 100 based on driving characteristics such as a resolution of the transparent display panel 10. Then, the aligned corrected image data R'G'B' is supplied to the data driver 300. Further, the timing controller 500 generates gate and data control signals GVS and DVS using synchronization signals input externally, and supplies the GVS and DVS to the gate driver 200 and data driver 300 respectively.

The power supply 400 supplies high and low potential voltages VDD and GND to each sub-pixel P via each of power lines PL1 to PLn so that each sub-pixel P charges the analog image signal therein and maintains a light-emitting state to display an image.

FIG. 4 is a block diagram specifically showing the transparent display image correction device shown in FIG. 1 and FIG. 2.

The transparent display image correction device 100 shown in FIG. 4 includes an illuminance detector 110, a transparent image determiner 120, a transparent optimal image analyzer 130, a non-transparent image analyzer 140, and a data corrector 150.

The illuminance detector 110 calculates and detects the background-affected illuminance based on a transmittance and a background illuminance of the transparent display panel 10 and an illuminance of a display image. To this end, the illuminance detector 110 can include a panel transmittance detector 112, a panel illuminance detector 113, a background illuminance detector 111, and a background-affected illuminance detector 114.

The panel transmittance detector 112 calculates and detects the transmittance of the transparent display panel 10 based on a percentage of an area of the transmissive portion TP relative to a total area of the transparent display panel 10, and based on percentage information depending on an arrangement form of the transmissive portion TP. In the connection, the panel transmittance detector 112 can receive and store transmittance information of the transparent display panel 10 from a manufacturer of the transparent display panel 10 or panel information database.

The panel illuminance detector 113 can be disposed on an image display surface of the transparent display panel 10, as shown in FIG. 1. The panel illuminance detector 113 detects an illuminance of the transparent transmissive portion TP and an illuminance of a region of the unit pixel PS of the transparent display panel 10 using at least one illuminance sensor. For example, the panel illuminance detector 113 detects illuminance variation resulting from the display image in real time using at least one illuminance sensor.

The background illuminance detector 111 can be separately disposed on an outermost component such as an outer casing or a support frame of the transparent display panel 10, as shown in FIG. 1. The background illuminance detector 111 detects illuminance of a surrounding background environment of the transparent display panel 10 in real time using at least one CMOS sensor.

The background-affected illuminance detector 114 performs calculation between at least one illuminance among the illuminance that varies based on the display image, the background environment illuminance of the transparent display panel 10, and an average background (or average reflectance) illuminance, and the transmittance of the transparent display panel 10, thereby to obtain the background-affected illuminance.

Specifically, the background-affected illuminance detector 114 can multiply the transmittance of the transparent display panel 10 by the background illuminance value of the transparent display panel 10, thereby to detect the corresponding background-affected illuminance for the transparent display panel 10.

Alternatively, the background-affected illuminance detector 114 can multiply the transmittance of the transparent display panel 10 by the illuminance value of the display image, thereby to detect the corresponding background-affected illuminance for the transparent display panel 10.

Further, the background-affected illuminance detector 114 can multiply the transmittance of the transparent display panel 10 by the background illuminance value of the transparent display panel 10, and the average background (or average reflectance) illuminance value, thereby to detect the corresponding background-affected illuminance for the transparent display panel 10. In the connection, the average background illuminance value or the average reflectance illuminance value can refer to a background illuminance average value for a preset period.

The background-affected illuminance detector 114 can transmit and share the background-affected illuminance calculated via one of the preset calculation schemes as described above to and with the transparent image determiner 120, the transparent optimal image analyzer 130, the non-transparent image analyzer 140, and the data corrector 150.

FIG. 5 is a diagram for illustrating a transparent image determination method by the transparent image determiner shown in FIG. 4.

As described above, an image displayed on the transparent display panel 10 is greatly affected by the background illuminance of the transparent display panel 10.

Thus, in order to increase a recognition level of the display image even in an environment having a high background illuminance as shown in FIG. 5, a high luminance image which can have a large grayscale difference between a dark low-grayscale and a bright high-grayscale is mainly displayed.

In order to display an image on the transparent display panel 10, the transparent image determiner 120 first determines whether image data input externally is transparent display-applicable image data suitable for transparent display so as to be displayed on the transparent display panel 10.

Specifically, the transparent image determiner 120 analyzes a grayscale of the image data RGB input externally and determines whether the image data is the transparent display-applicable image data, based on the analysis result. In this connection, the transparent image determiner 120 sequentially compares a grayscale value of each pixel with a preset low-grayscale value (for example, 95 grayscale among 0 to 255 grayscales) on at least one frame basis, and counts the number of pixels having a low-grayscale value equal to or lower than the preset low-grayscale value. Then, when a percentage of the number of pixels having a low-grayscale value equal to or lower than the preset low-grayscale value relative to a total number of pixels corresponding to at least one frame is larger than a preset percentage, for example, 65%, the transparent image determiner 120 determines that the image data RGB of the corresponding frame is the transparent display-applicable image data having a high percentage of low-grayscale data.

The transparent optimal image analyzer 130 sequentially receives the image data RGB determined as the transparent display-applicable image data every frame. In this connection, the transparent optimal image analyzer 130 calculates low-grayscale recognition-level information and low-grayscale recognition-level limit information based on the background-affected illuminance from the background-affected illuminance detector 114. Then, the transparent optimal image analyzer 130 sets a grayscale value corresponding to the low-grayscale recognition-level limit based on the calculated low-grayscale recognition-level information and low-grayscale recognition-level limit information, and then extracts an average grayscale value which varies based on the grayscale value corresponding to the low-grayscale recognition-level limit.

In order to set the grayscale value corresponding to the low-grayscale recognition-level limit, and to extract the average grayscale value that varies based on the grayscale value corresponding to the low-grayscale recognition-level limit, the transparent optimal image analyzer 130 can include a low-grayscale recognition-level calculator 131, a grayscale limit detector 132, and a variable APL detector 133.

The low-grayscale recognition-level calculator 131 stores and shares low-grayscale recognition-level information data including a mapping (Table 1) between a numerical value of a recognition-level of an image displayed on the transparent display panel 10 and a numerical value of the background illuminance or the background-affected illuminance.

TABLE 1

| Background-affected iliuminance | Low-grayscale recognition-level (Grey) |
|---|---|
| 0 | 0 |
| 50 | 10 |
| 100 | 15 |
| . . . | . . . |
| 1000 | 30 |

The low-grayscale recognition-level calculator 131 can receive and store the low-grayscale recognition-level information data as shown in Table 1 above from a manufacturer of the transparent display panel 10 or panel information database thereof.

Thus, when the low-grayscale recognition-level calculator 131 receives the background-affected illuminance value from the background-affected illuminance detector 114, the low-grayscale recognition-level calculator 131 calculates the low-grayscale recognition-level information corresponding to the input background-affected illuminance value.

The grayscale limit detector 132 stores and shares the grayscale recognition-level limit information data including a mapping (Table 2) between a numeral value of a low-grayscale minimum brightness for recognition of an image displayed on the transparent display panel 10 and a numerical value of the background-affected illuminance

TABLE 2

| Background-affected illuminance (background × illuminance) | Grayscale recognition-level limit (nit) * | Optimal luminance (nit) * |
|---|---|---|
| 0 | 0 | 80 |
| 50 | 10 | 100 |
| 300 | 20 | 200 |
| 1000 | 30 | 500 |
| . . . | . . . | . . . |
| 10000 | . . . | . . . |

The grayscale limit detector 132 receives and stores the low-grayscale minimum brightness (nit), for example, the low-grayscale recognition-level limit information data as shown in Table 2 above from a manufacturer or panel information database of the transparent display panel 10.

Thus, when the grayscale limit detector 132 receives the background-affected illuminance value from the background-affected illuminance detector 114, the grayscale limit detector 132 can calculate the low-grayscale recognition-level limit information corresponding to the input background-affected illuminance value.

The variable APL detector 133 can set the grayscale value corresponding to the low-grayscale recognition-level limit for the corresponding background-affected illuminance, based on the low-grayscale recognition-level limit information corresponding to the input background-affected illuminance value from the grayscale limit detector 132. This setting can be intended to exclude all grayscale values below the grayscale value corresponding to the low-grayscale recognition-level limit. In other words, the average grayscale value can be obtained using recognizable grayscale values, and, then the peak luminance can be set based on the average grayscale value.

$$APLET\ (\%) = \frac{\sum \{\max(R, G, B)/255\}}{(\#\ \text{of pixels}) - (\#\ \text{of Except pixels})} \times 100(\%) \quad \text{[Equation 1]}$$

$$(\#\ \text{of Except pixels}) = \left(\#\ \text{of pixels} < \begin{matrix}\text{Recognition}\\ \text{limit}\end{matrix}\right)$$

In this way, the variable APL detector 133 can use the above Equation 1 to calculate the average grayscale value APLET (%) for recognizable grayscale values (# of pixels−# of Except pixels) while excluding all of the grayscale values (# of Except pixels) below the grayscale value corresponding to the low-grayscale recognition-level limit.

The data corrector 150 varies the peak luminance of the image data RGB based on the background-affected illuminance and the average grayscale value APLET (%) to generate the corrected image data MR, MG, and MB.

FIG. 6 is a graph to illustrate a method for setting a luminance weight by the luminance weight detector shown in FIG. 4.

Referring to FIG. 6, the luminance weight detector 151 of the data corrector 150 sets the peak luminance level to correspond to the average grayscale value APLET (%) calculated by the variable APL detector 133. The luminance weight detector 151 varies the luminance weight α* based on the set peak luminance level.

TABLE 3

| Background-affected illuminance (background × illuminance) | Grayscale recognition-level limit (nit) * | Optimal luminance (nit) * | Luminance weight α * |
|---|---|---|---|
| 0 | 0 | 80 | 0.2 |
| 50 | 10 | 100 | 0.25 |
| 300 | 20 | 200 | 0.5 |
| 1000 | 30 | 500 | 1 |
| . . . | . . . | . . . | 1 |
| 10000 | . . . | . . . | 1 |

Specifically, the luminance weight detector 151 can vary the luminance weight α* to correspond to the background-affected illuminance detected by the background-affected illuminance detector 114 as shown in Table 3.

For example, as shown in Table 3 above, when the background-affected illuminance is greater than a specific value of 1000, it is preferable to apply the detected peak luminance level as it is, in order to increase the recognition-level. Therefore, the luminance weight detector 151 ensures that the luminance weight α* is fixed to 1 when the background-affected illuminance is greater than a specific value of 1000.

However, when the background-affected illuminance is below a specific value of 1000, the recognition-level is increased, and the low-grayscale recognition-level limit is lowered. In this case, it is not necessary to apply the detected peak luminance level as it is. Thus, the luminance weight detector 151 can lower the luminance weight α* to a preset value (values set to a range of 0.1 to 0.9) lower than 1 to lower the peak luminance.

The image data corrector 152 can apply the luminance weight α* varying based on the background-affected illuminance to the grayscale value or a luminance value of each pixel of the input image data RGB, thereby to create the corrected image data MR, MG, and MB having the adjusted peak luminance of the image data RGB.

The data corrector 150 can apply the greater weight in the darker environment so that the peak luminance can be lowered. Thus, in the darker environment, the display quality of the transparent display image can be maintained while reducing the amount of power consumption of the display panel, thereby increasing the use efficiency thereof.

In one example, when the input image data is not the transparent display-applicable image data but is suitable for being displayed in a non-transparent display, for example, the input image data is non-transparent image data, the non-transparent image analyzer 140 sequentially receives the non-transparent image data on at least one frame basis. Accordingly, the non-transparent image analyzer 140 calculates an average grayscale value of the non-transparent image data for each frame and determines a peak luminance level corresponding to the average grayscale value for each frame.

$$APL(\%) = \frac{\sum \{\max(R, G, B)/255\}}{\#\text{ of pixels}} \times 100(\%) \quad \text{[Equation 2]}$$

The APL detector 141 of the non-transparent image analyzer 140 calculates the average grayscale value APL (%) of the grayscale values (# of pixels) of all pixels of the non-transparent image data using the above Equation 2.

FIG. 7 is a graph to illustrate the peak luminance detection method and a peak luminance correction method by the non-transparent image analyzer shown in FIG. 4.

Referring to FIG. 7, the peak luminance detector 142 of the non-transparent image analyzer 140 sets the peak luminance level to correspond to the average grayscale value APL (%) as detected by the APL detector 141. The peak luminance level set by the peak luminance detector 142 is supplied to the luminance weight detector 151 of the data corrector 150.

Accordingly, the luminance weight detector 151 sets the luminance weight α* based on the peak luminance level detected by the peak luminance detector 142.

Similarly, the luminance weight detector 151 can vary the luminance weight α* to correspond to the background-affected illuminance detected by the background-affected illuminance detector 114, as shown in Table 3 above. For example, when the background-affected illuminance is below a specific value of 1000, it is not necessary to apply the peak luminance level detected by the peak luminance detector 142 as it is. For example, it is not necessary to apply the high peak luminance level. Thus, the luminance weight α* can be lowered to the preset value (values from 0.1 to 0.9) smaller than 1, thereby lowering the peak luminance.

Subsequently, the image data corrector 152 applies the luminance weight α* varying based on the background-affected illuminance to the grayscale value or the luminance value of each pixel of the input image data RGB, thereby to create the corrected image data MR, MG, and MB having the adjusted peak luminance of the image data RGB. The image data corrector 152 sequentially supplies the corrected image data MR, MG, and MB with the adjusted peak luminance to the timing controller 500, so that an image corresponding to the corrected image data MR, MG, and MB can be displayed on the transparent display panel 10. The luminance of the non-transparent display image data can be adjusted based on the operating characteristics of the non-transparent image analyzer 140 and the data corrector 150. Then, an image corresponding thereto can be displayed as a transparent display image. Thus, the field of application of the transparent display panel 10 can be further expanded.

FIG. 8 is a view showing the image data input to the transparent display image correction device in FIG. 4 and a transparent display image based on the luminance correction.

Here, (a) in FIG. 8 shows an example of a displayed image corresponding to the transparent display-applicable image data, whereas (b) in FIG. 8 shows an example of an image displayed on the transparent display panel based on the background-affected illuminance.

Referring to (a) in FIG. 8 and (b) in FIG. 8, the transparent image determiner 120 according to the present disclosure analyzes the grayscale of the image data RGB input externally and determines whether the image data is the transparent display-applicable image data based on the analysis result. Accordingly, the average grayscale value of the image data RGB determined as the transparent display-applicable image data can be calculated based on the recognizable grayscale values while excluding all grayscale values below the grayscale value corresponding to the low-grayscale recognition-level limit. Thus, the peak luminance can be adjusted based on the average grayscale value. In this connection, the grayscale value corresponding to the low-grayscale recognition-level limit can be determined based on the low-grayscale recognition-level and the low-grayscale recognition-level limit based on the background-affected illuminance.

Then, the luminance weight α* is set based on the peak luminance level. In the darker environment, the luminance weight α* is lowered to further lower the peak luminance.

Therefore, as shown in (b) in FIG. 8, as the background environment is darker, the display quality of the transparent display image is maintained while reducing the amount of power consumption of the transparent display panel, thereby increasing the efficiency of the use of the panel.

Further, according to the present disclosure, the luminance of the non-transparent image data to be displayed on the transparent display panel 10 can be corrected and displayed in real time based on the operating characteristics of the non-transparent image analyzer 140 and the data corrector 150. In this way, the luminance of an input image can be adjusted in real time and then the corrected image data can be display, without separately producing or distinguishing a transparent display image. Thus, an application range of the transparent display device can be further expanded.

In a first aspect of the present disclosure, a device for correcting an image on a transparent display includes an illuminance detector configured to detect a background-affected illuminance for a transparent display panel; a transparent image determiner configured to analyze a grayscale of image data input externally and determine, based on the analysis result, whether the input image data is suitable for being displayed on the transparent display panel; a transparent optimal image analyzer configured to extract, upon determination that the input image data is suitable, an average grayscale value from the input image data, wherein the average grayscale value varies based on a grayscale value corresponding to a low-grayscale recognition-level limit; and a data corrector configured to adjust a peak luminance of the image data based on the background-affected illuminance and the average grayscale value, thereby to generate corrected image data.

In one implementation of the correction device, the illuminance detector is configured to perform calculation between a transmittance of the transparent display panel and at least one of an illuminance varying based on a display image on the transparent display panel, a background environment illuminance of the transparent display panel, or an average background illuminance thereof, thereby to obtain the background-affected illuminance.

In one implementation of the correction device, the transparent image determiner is configured to sequentially compare a grayscale value of each pixel corresponding to at least one frame with a preset low-grayscale value and count a number of pixels having a low-grayscale value equal to or lower than the preset low-grayscale value; and when a percentage of the number of pixels having the low-grayscale equal to or lower than the preset low-grayscale value relative to a total number of pixels corresponding to the at least one frame is greater than a present percentage, determine that the input image data corresponding to the at least one frame is suitable for being displayed on the transparent display panel.

In one implementation of the correction device, the transparent optimal image analyzer is configured to calculate low-grayscale recognition-level information and low-grayscale recognition-level limit information based on the detected background-affected illuminance; set a grayscale value corresponding to the low-grayscale recognition-level limit based on the calculated low-grayscale recognition-level information, and low-grayscale recognition-level limit information; an extract an average grayscale value varying based on the grayscale value corresponding to the low-grayscale recognition-level limit.

In one implementation of the correction device, the transparent optimal image analyzer includes a low-grayscale recognition-level calculator configured to store and share low-grayscale recognition-level information data including a mapping between a numerical value of a recognition-level of an image displayed on the transparent display panel and a numerical value of the background-affected illuminance; a grayscale limit detector configured to store and share low-grayscale recognition-level limit information data including a mapping between a numerical value of the low-grayscale recognition-level limit for recognition of an image displayed on the transparent display panel and a numerical value of the background-affected illuminance; and a variable APL (e.g., average peak luminance) detector configured to: set the grayscale value corresponding to the low-grayscale recognition-level limit corresponding to the background-affected illuminance, based on the low-grayscale recognition-level information and the low-grayscale recognition-level limit information; and calculate an average grayscale value of recognizable grayscale values using a preset average grayscale value calculating equation, wherein the recognizable grayscale values are free of all of grayscale values below the set grayscale value corresponding to the low-grayscale recognition-level limit.

In one implementation of the correction device, the data corrector includes: a luminance weight detector configured to set a peak luminance level so as to correspond to the average grayscale value detected by the variable APL detector; and vary a luminance weight based on the set peak luminance level; and an image data corrector configured to apply the varied luminance weight to a grayscale value or luminance value of each pixel of the input image data to obtain a corrected peak luminance of the image data, thereby to generate the corrected image data having the corrected peak luminance.

In one implementation of the correction device, the luminance weight detector is configured to vary the luminance weight to a preset value smaller than 1 when the background-affected illuminance is lower than or equal to a preset value.

In one implementation of the correction device, the device further comprises a non-transparent image analyzer, wherein when the input image data is determined as a non-transparent image data not suitable for being displayed on the transparent display panel.

The non-transparent image analyzer is configured to: calculate an average grayscale value of the non-transparent image data for each frame; and determine a peak luminance level of the non-transparent image data corresponding to the calculated average grayscale value.

In one implementation of the correction device, the data corrector is configured to: vary a luminance weight based on the peak luminance level detected by the non-transparent image analyzer; apply the varied luminance weight to a grayscale value or luminance value of each pixel of the non-transparent image data to obtain a corrected peak luminance of the image data, thereby to generate the corrected image data having the corrected peak luminance.

In a second aspect of the present disclosure, a transparent display device includes a transparent display panel having a plurality of transmissive portions and a pixel region to display an image; a gate driver configured to drive gate lines of the transparent display panel; a data driver configured to drive data lines of the transparent display panel; a transparent display image correction device configured to calculate a background-affected illuminance of the transparent display panel in real time; and vary input image data so that a peak luminance of a display image is adjusted based on the calculated background-affected illuminance, thereby to generate corrected image data; and a timing controller configured to align the corrected image data based on driving characteristics of the transparent display panel and supply the aligned corrected image data to the data driver, and, further, to control the data driver and gate driver.

In one implementation of the display device, the correction device includes an illuminance detector configured to detect a background-affected illuminance for a transparent display panel; a transparent image determiner configured to analyze a grayscale of image data input externally and determine, based on the analysis result, whether the input image data is suitable for being displayed on the transparent display panel; a transparent optimal image analyzer configured to extract, upon determination that the input image data is suitable, an average grayscale value from the input image data, wherein the average grayscale value varies based on a grayscale value corresponding to a low-grayscale recognition-level limit; and A data corrector configured to adjust a peak luminance of the image data based on the background-affected illuminance and the average grayscale value, thereby to generate the corrected image data.

In one implementation of the display device, the transparent display image correction device is included in the transparent display panel or a main body of the transparent display device; or wherein the correction device is included in a separate set-top box or casing and thus is a separate component from the transparent display panel or the main body of the transparent display device; and wherein the illuminance detector is disposed on an outer face of the transparent display panel.

In one implementation of the display device, the transparent optimal image analyzer is configured to calculate low-grayscale recognition-level information and low-grayscale recognition-level limit information based on the detected background-affected illuminance; set a grayscale value corresponding to the low-grayscale recognition-level limit based on the calculated low-grayscale recognition-level information, and low-grayscale recognition-level limit information; and extract an average grayscale value varying based on the grayscale value corresponding to the low-grayscale recognition-level limit.

In one implementation of the display device, the transparent optimal image analyzer includes a low-grayscale recognition-level calculator configured to store and share low-grayscale recognition-level information data including a mapping between a numerical value of a recognition-level of an image displayed on the transparent display panel and a numerical value of the background-affected illuminance; a grayscale limit detector configured to store and share low-grayscale recognition-level limit information data including a mapping between a numerical value of the low-grayscale recognition-level limit for recognition of an image displayed on the transparent display panel and a numerical value of the background-affected illuminance; and a variable APL detector configured to: set the grayscale value corresponding to the low-grayscale recognition-level limit corresponding to the background-affected illuminance, based on the low-grayscale recognition-level information and the low-grayscale recognition-level limit information; and calculate an average grayscale value of recognizable grayscale values using a preset average grayscale value calculating equation, wherein the recognizable grayscale values are free of all of grayscale values below the set grayscale value corresponding to the low-grayscale recognition-level limit.

In one implementation of the display device, the data corrector is configured to: set a peak luminance level so as to correspond to the average grayscale value detected by the variable APL detector; vary a luminance weight based on the set peak luminance level; and apply the varied luminance weight to a grayscale value or luminance value of each pixel of the input image data to obtain a corrected peak luminance of the image data, thereby to generate the corrected image data having the corrected peak luminance.

In a third aspect of the present disclosure, a method for driving a transparent display device includes calculating in real time a background-affected illuminance of a transparent display panel; varying input image data so that a peak luminance of a display image is adjusted based on the calculated background-affected illuminance, thereby generating corrected image data; and aligning the corrected image data based on driving characteristics of the transparent display panel and displaying the aligned corrected image data on the transparent display panel.

In one implementation of the method, generating the corrected image data includes analyzing a grayscale of image data input externally and determining, based on the analysis result, whether the input image data is suitable for being displayed on the transparent display panel; extracting, upon determination that the input image data is suitable, an average grayscale value from the input image data, wherein the average grayscale value varies based on a grayscale value corresponding to a low-grayscale recognition-level limit; and adjusting a peak luminance of the image data based on the background-affected illuminance and the average grayscale value, thereby to generate the corrected image data.

In one implementation of the method, extracting the average grayscale value includes storing low-grayscale recognition-level information data including a mapping between a numerical value of a recognition-level of an image displayed on the transparent display panel and a numerical value of the background-affected illuminance; storing low-grayscale recognition-level limit information data including a mapping between a numerical value of the low-grayscale recognition-level limit for recognition of an image displayed on the transparent display panel and a numerical value of the background-affected illuminance; setting the grayscale value corresponding to the low-grayscale recognition-level limit corresponding to the background-affected illuminance, based on the low-grayscale recognition-level information and the low-grayscale recognition-level limit information; and calculating an average grayscale value of recognizable grayscale values using a preset average grayscale value calculating equation, wherein the recognizable grayscale values are free of all of grayscale values below the set grayscale value corresponding to the low-grayscale recognition-level limit.

In one implementation of the method, varying the peak luminance of the image data to generate the corrected image data includes setting a peak luminance level so as to correspond to the calculated average grayscale value; varying a luminance weight based on the set peak luminance level; and applying the varied luminance weight to a grayscale value or luminance value of each pixel of the input image data to obtain a corrected peak luminance of the image data, thereby to generate the corrected image data having the corrected peak luminance.

As described above, the present disclosure is described with reference to the drawings. However, the present disclosure is not limited by the embodiments and drawings disclosed in the present specification. It will be apparent that various modifications can be made thereto by those skilled in the art within the scope of the present disclosure. Furthermore, although the effect resulting from the features of the present disclosure has not been explicitly described in the description of the embodiments of the present disclosure, it is obvious that a predictable effect resulting from the features of the present disclosure should be recognized.

What is claimed is:

1. A correction device for correcting an image on a transparent display, the correction device comprising:

an illuminance detector configured to detect a background-affected illuminance for a transparent display panel;

a transparent image determiner configured to analyze a grayscale of image data input externally and determine, based on the analysis result, whether the input image data is suitable for being displayed on the transparent display panel;

a transparent optimal image analyzer configured to extract, upon determination that the input image data is suitable, an average grayscale value from the input image data, wherein the average grayscale value varies based on a grayscale value corresponding to a low-grayscale recognition-level limit; and a data corrector configured to adjust a peak luminance of the image data based on the background-affected illuminance and the average grayscale value, so as to generate corrected image data, wherein the transparent image determiner is configured to:

sequentially compare a grayscale value of each pixel corresponding to at least one frame with a preset low-grayscale value and count a number of pixels having a low-grayscale value equal to or lower than the preset low-grayscale value; and when a percentage of the number of pixels having the low-grayscale value equal to or lower than the preset low-grayscale value relative to a total number of pixels corresponding to the at least one frame is greater than a preset percentage, determine that the input image data corresponding to the at least one frame is suitable for being displayed on the transparent display panel.

2. The correction device of claim 1, wherein the illuminance detector is configured to perform calculation between a transmittance of the transparent display panel and at least one of an illuminance varying based on a display image on the transparent display panel, a background environment illuminance of the transparent display panel, or an average background illuminance thereof, thereby to obtain the background-affected illuminance.

3. The correction device of claim 1, wherein the transparent optimal image analyzer is configured to:

calculate low-grayscale recognition-level information and low-grayscale recognition-level limit information based on the detected background-affected illuminance;

set a grayscale value corresponding to the low-grayscale recognition-level limit based on the calculated low-grayscale recognition-level information, and low-grayscale recognition-level limit information; and extract an average grayscale value varying based on the grayscale value corresponding to the low-grayscale recognition-level limit.

4. The correction device of claim 3, wherein the transparent optimal image analyzer includes:

a low-grayscale recognition-level calculator configured to store and share low-grayscale recognition-level information data including a mapping between a numerical value of a recognition-level of an image displayed on the transparent display panel and a numerical value of the background-affected illuminance;

a grayscale limit detector configured to store and share low-grayscale recognition-level limit information data including a mapping between a numerical value of the low-grayscale recognition-level limit for recognition of an image displayed on the transparent display panel and a numerical value of the background-affected illuminance; and a variable APL detector configured to:

set the grayscale value corresponding to the low-grayscale recognition-level limit corresponding to the background-affected illuminance, based on the low-grayscale recognition-level information and the low-grayscale recognition-level limit information; and calculate an average grayscale value of recognizable grayscale values using a preset average grayscale value calculating equation, wherein the recognizable grayscale values are free of all of grayscale values below the set grayscale value corresponding to the low-grayscale recognition-level limit.

5. The correction device of claim 4, wherein the data corrector includes:

a luminance weight detector configured to:

set a peak luminance level so as to correspond to the average grayscale value detected by the variable APL detector; and vary a luminance weight based on the set peak luminance level; and an image data corrector configured to apply the varied luminance weight to a grayscale value or luminance value of each pixel of the input image data to obtain a corrected peak luminance of the image data, thereby to generate the corrected image data having the corrected peak luminance.

6. The correction device of claim 5, wherein the luminance weight detector is configured to vary the luminance weight to a preset value smaller than 1 when the background-affected illuminance is lower than or equal to a preset value.

7. The correction device of claim 1, wherein the correction device further comprises a non-transparent image analyzer, wherein when the input image data is determined as a non-transparent image data not suitable for being displayed on the transparent display panel, the non-transparent image analyzer is configured to:

calculate an average grayscale value of the non-transparent image data for each frame; and determine a peak luminance level of the non-transparent image data corresponding to the calculated average grayscale value.

8. The correction device of claim 7, wherein the data corrector is configured to:

vary a luminance weight based on the peak luminance level detected by the non-transparent image analyzer; and apply the varied luminance weight to a grayscale value or luminance value of each pixel of the non-transparent image data to obtain a corrected peak luminance of the image data, thereby to generate the corrected image data having the corrected peak luminance.

9. A transparent display device comprising:

a transparent display panel having a plurality of transmissive portions and a pixel region to display an image;

a gate driver configured to drive gate lines of the transparent display panel;

a data driver configured to drive data lines of the transparent display panel;

a transparent display image correction device configured to:

calculate a background-affected illuminance of the transparent display panel in real time; and vary input image data so that a peak luminance of a display image is adjusted based on the calculated background-affected illuminance, so as to generate corrected image data; and a timing controller configured to align the corrected image data based on driving characteristics of the transparent display panel and supply the aligned corrected image data to the data driver, and control the data driver and gate driver, wherein the transparent display image correction device includes a transparent image determiner configured to analyze a grayscale of image data input externally and determine, based on the analysis result, whether the input image data is suitable for being displayed on the transparent display panel, and wherein the transparent image determiner is further configured to:

sequentially compare a grayscale value of each pixel corresponding to at least one frame with a preset low-grayscale value and count a number of pixels having a low-grayscale value equal to or lower than the preset low-grayscale value; and when a percentage of the number of pixels having the low-grayscale value equal to or lower than the preset low-grayscale value relative to a total number of pixels corresponding to the at least one frame is greater than a preset percentage, determine that the input image data corresponding to the at least one frame is suitable for being displayed on the transparent display panel.

10. The transparent display device of claim 9, wherein the transparent display image correction device further includes:

an illuminance detector configured to detect a background-affected illuminance for the transparent display panel;

a transparent optimal image analyzer configured to extract, upon determination that the input image data is suitable, an average grayscale value from the input image data, wherein the average grayscale value varies based on a grayscale value corresponding to a low-grayscale recognition-level limit; and a data corrector configured to adjust a peak luminance of the image data based on the background-affected illuminance and the average grayscale value, thereby to generate the corrected image data.

11. The transparent display device of claim 10, wherein the transparent display image correction device is included in the transparent display panel or a main body of the transparent display device; or wherein the transparent display image correction device is included in a separate set-top box or casing and thus is a separate component from the transparent display panel or the main body of the transparent display device; and wherein the illuminance detector is disposed on an outer face of the transparent display panel.

12. The transparent display device of claim 10, wherein the transparent optimal image analyzer is configured to:

calculate low-grayscale recognition-level information and low-grayscale recognition-level limit information based on the detected background-affected illuminance;

set a grayscale value corresponding to the low-grayscale recognition-level limit based on the calculated low-grayscale recognition-level information, and low-grayscale recognition-level limit information; and extract an average grayscale value varying based on the grayscale value corresponding to the low-grayscale recognition-level limit.

13. The transparent display device of claim 12, wherein the transparent optimal image analyzer includes:

a low-grayscale recognition-level calculator configured to store and share low-grayscale recognition-level information data including a mapping between a numerical value of a recognition-level of an image displayed on the transparent display panel and a numerical value of the background-affected illuminance;

a grayscale limit detector configured to store and share low-grayscale recognition-level limit information data including a mapping between a numerical value of the low-grayscale recognition-level limit for recognition of an image displayed on the transparent display panel and a numerical value of the background-affected illuminance; and a variable APL detector configured to:

set the grayscale value corresponding to the low-grayscale recognition-level limit corresponding to the background-affected illuminance, based on the low-grayscale recognition-level information and the low-grayscale recognition-level limit information; and calculate an average grayscale value of recognizable grayscale values using a preset average grayscale value calculating equation, wherein the recognizable grayscale values are free of all of grayscale values below the set grayscale value corresponding to the low-grayscale recognition-level limit.

14. The transparent display device of claim 13, wherein the data corrector is configured to:

set a peak luminance level so as to correspond to the average grayscale value detected by the variable APL detector;

vary a luminance weight based on the set peak luminance level; and apply the varied luminance weight to a grayscale value or luminance value of each pixel of the input image data to obtain a corrected peak luminance of the image data, thereby to generate the corrected image data having the corrected peak luminance.

15. A method for driving a transparent display device, the method comprising:

calculating in real time a background-affected illuminance of a transparent display panel;

varying input image data so that a peak luminance of a display image is adjusted based on the calculated background-affected illuminance, thereby generating corrected image data; and aligning the corrected image data based on driving characteristics of the transparent display panel and displaying the aligned corrected image data on the transparent display panel, wherein the generating the corrected image data includes:

analyzing a grayscale of image data input externally and determining, based on the analysis result, whether the input image data is suitable for being displayed on the transparent display panel, wherein the determining of whether the input image data is suitable for being displayed on the transparent display pane includes:

sequentially comparing a grayscale value of each pixel corresponding to at least one frame with a preset low-grayscale value and counting a number of pixels having a low-grayscale value equal to or lower than the preset low-grayscale value; and when a percentage of the number of pixels having the low-grayscale value equal to or lower than the preset low-grayscale value relative to a total number of pixels corresponding to the at least one frame is greater than a preset percentage, determining that the input image data corresponding to the at least one frame is suitable for being displayed on the transparent display panel.

16. The method of claim 15, wherein the generating the corrected image data includes:

analyzing a grayscale of image data input externally and determining, based on the analysis result, whether the input image data is suitable for being displayed on the transparent display panel;

extracting, upon determination that the input image data is suitable, an average grayscale value from the input image data, wherein the average grayscale value varies based on a grayscale value corresponding to a low-grayscale recognition-level limit; and adjusting a peak luminance of the image data based on the background-affected illuminance and the average grayscale value, thereby to generate the corrected image data.

17. The method of claim 16, wherein the extracting the average grayscale value includes:

storing low-grayscale recognition-level information data including a mapping between a numerical value of a recognition-level of an image displayed on the transparent display panel and a numerical value of the background-affected illuminance;

storing low-grayscale recognition-level limit information data including a mapping between a numerical value of the low-grayscale recognition-level limit for recognition of an image displayed on the transparent display panel and a numerical value of the background-affected illuminance;

setting the grayscale value corresponding to the low-grayscale recognition-level limit corresponding to the background-affected illuminance, based on the low-grayscale recognition-level information and the low-grayscale recognition-level limit information; and calculating an average grayscale value of recognizable grayscale values using a preset average grayscale value calculating equation, wherein the recognizable grayscale values are free of all of grayscale values below the set grayscale value corresponding to the low-grayscale recognition-level limit.

18. The method of claim 16, wherein the varying the peak luminance of the image data to generate the corrected image data includes:

setting a peak luminance level so as to correspond to the calculated average grayscale value;

varying a luminance weight based on the set peak luminance level; and applying the varied luminance weight to a grayscale value or luminance value of each pixel of the input image data to obtain a corrected peak luminance of the image data, thereby to generate the corrected image data having the corrected peak luminance.

* * * * *